US008761432B1

(12) United States Patent
Cheng

(10) Patent No.: US 8,761,432 B1
(45) Date of Patent: Jun. 24, 2014

(54) SPEAKER MODULE AND ELECTRONIC DEVICE EMPLOYING SAME

(71) Applicant: Chiun Mai Communication Systems, Inc., New Taipei (TW)

(72) Inventor: Chuan-Hsien Cheng, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 14/014,647

(22) Filed: Aug. 30, 2013

(30) Foreign Application Priority Data

Jan. 9, 2013 (TW) ..... 102100672 A

(51) Int. Cl.
*H04R 1/02* (2006.01)
*H04R 1/20* (2006.01)

(52) U.S. Cl.
USPC ..... 381/395; 381/338; 381/345; 381/351; 381/352

(58) Field of Classification Search
USPC ..... 381/395, 338, 345, 351–352
See application file for complete search history.

(56) References Cited

U.S. PATENT DOCUMENTS

2014/0003647 A1* 1/2014 Liu ..... 381/386

* cited by examiner

*Primary Examiner* — Brian Ensey
*Assistant Examiner* — Norman Yu
(74) *Attorney, Agent, or Firm* — Novak Druce Connolly Bove + Quigg LLP

(57) ABSTRACT

An electronic device includes an internal speaker module and an external sound box detachably applied to the internal speaker module. The valve is resisted to the opening to cover the opening of the internal speaker module. When external sound box is applied to the internal speaker module, the connector is magnetically attracted with the magnetic attracter, while the valve is magnetically repelled from the connector and moves away from the opening to open the opening, thereby the external sound chamber is communicating with the internal sound chamber.

20 Claims, 6 Drawing Sheets

SPEAKER MODULE AND ELECTRONIC DEVICE EMPLOYING SAME

BACKGROUND

1. Technical Field

The present disclosure relates to a speaker module having an external sound box and an internal speaker module, especially to an electronic device employing an external sound box.

2. Description of Related Art

Electronic devices have speaker modules for playing audio files. Usually, a space is designed in the speaker module as a sound chamber for sound resonating. However, the room for resonating sound generated by the speaker is very limited, due to miniaturization of the electronic device. Thereby, the sound performance of the speaker module is decreased, especially for the low frequency sound. Thus, improving sound performance in the condition of size limited is needed.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
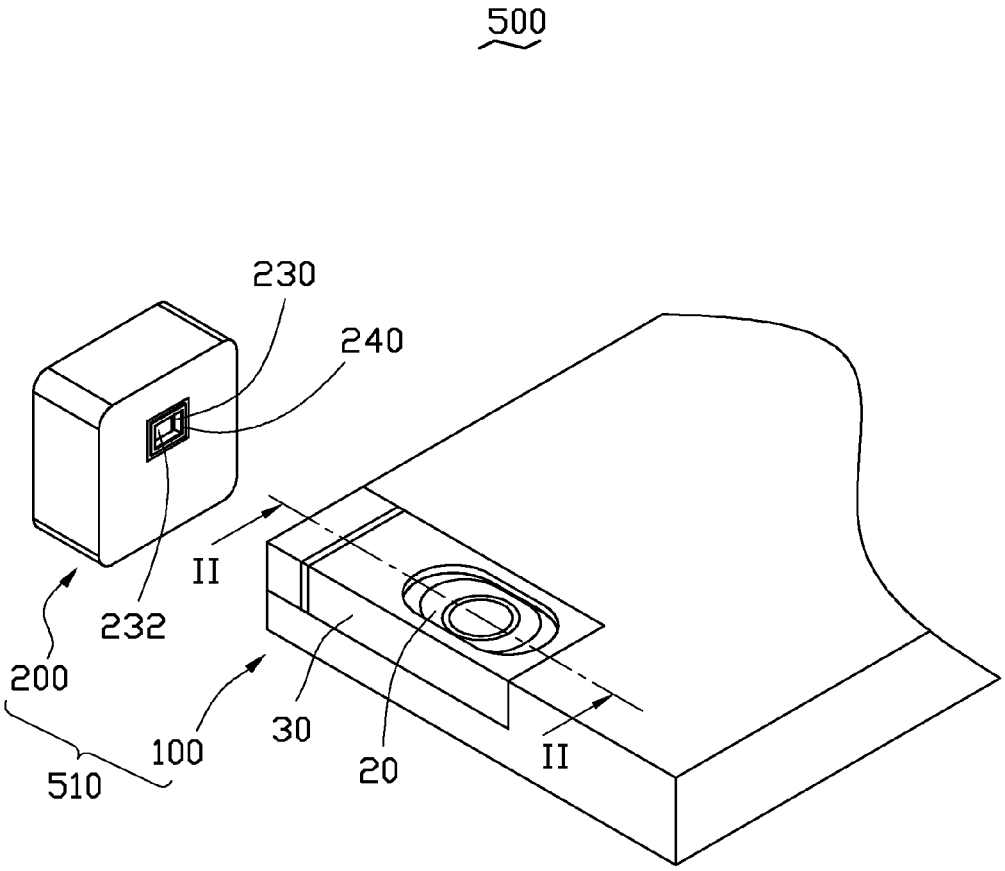
FIG. 1 is an isometric view of an exemplary embodiment of an electronic device and an external sound box.

FIG. 1 shows an electronic device 500 according to an exemplary embodiment. The electronic device 500 is capable of detachably connecting to an external sound box 200 to improve sound performance. In this embodiment, the electronic device 500 is a mobile phone. In other embodiments, the electronic device 500 could be a personal digital assistant, a tablet computer or an MP3 player, for example.

Figure 2:
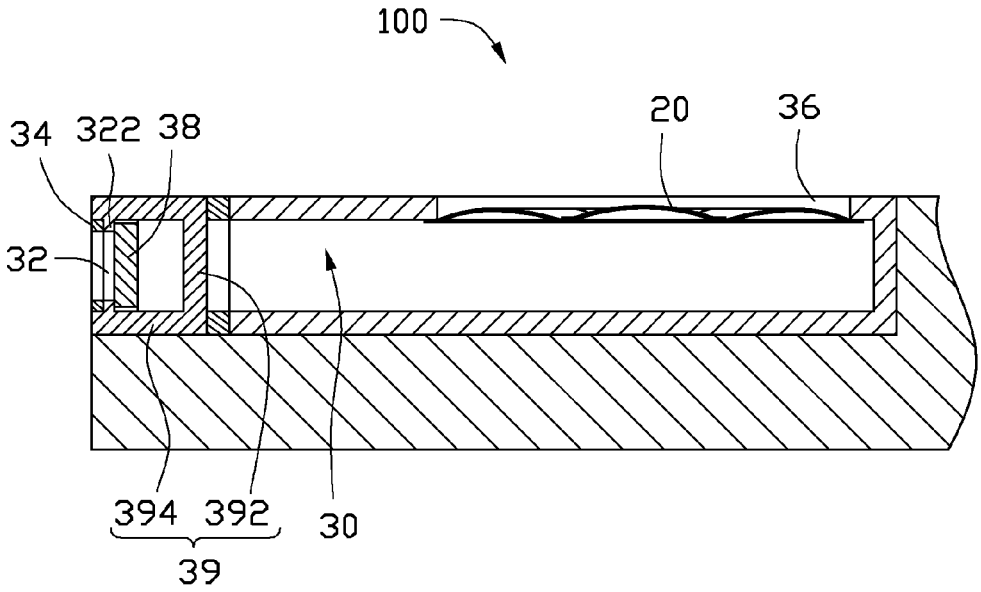
FIG. 2 is a cross-section view taken along line II-II of the electronic device shown in FIG. 1.

FIG. 2 shows that the electronic device 500 includes a speaker assembly 510. The speaker assembly 510 includes an internal speaker module 100 and the external sound box 200. The external sound box 200 is detachably connected to, and communicating with, the internal speaker module 100. The internal speaker module 100 includes a speaker 20 and an internal sound chamber 30. The internal sound chamber 30 is formed inside the electronic device 500, or is mounted in the electronic device 500 after being manufactured independently.

In the exemplary embodiment, the internal sound chamber 30 includes an opening 32, a magnetic attracter 34, a receiving hole 36, a valve 38, and a guiding portion 39. An inner surface of the internal sound chamber 30 is made of airtight material, to prevent sound leakage from the internal sound chamber 30. The opening 32 is defined on an end of the internal sound chamber 30, such that an inside space of the internal sound chamber 30 is capable of communicating with outside of the electronic device 500 via the opening 32. In the exemplary embodiment, the opening 32 is defined in one appearance surface of the electronic device 500. A flange 322 is formed surrounding an inner wall of the opening 32, and there is a predetermined distance between the flange 322 and the appearance surface of the electronic device 500.

The magnetic attracter 34 is for magnetically attracting the valve 38 and the external sound box 200. The magnetic attracter 34 is annular, and is mounted on an outside of the flange 322 facing the outside of the internal sound chamber 30. The magnetic attracter 34 is made of magnetic attracting material, such as ferrous material, iron, cobalt, nickel, chromium, and mixtures of these materials. A hole is defined in a central portion of the magnetic attracter 34 to expose the opening 32.

The receiving hole 36 is defined on another end of the internal sound chamber 30 away from the opening 32. The receiving hole 36 is for communicating between the inside of the internal sound chamber 30 and the outside of the electronic device 500. In the exemplary embodiment, the receiving hole 36 is defined in a skin surface of the electronic device 500. The speaker 20 is received in the receiving hole 36 and is electrically connected to a motherboard of the electronic device 500 to play audio files and generate sound. Sound generated by the speaker 20 resonates in the internal sound chamber 30 and transmits outside through the receiving hole 36 or other sound holes of the electronic device 500 communicating with the internal sound chamber 30.

The valve 38 is slidably mounted in the internal sound chamber 30. The valve 38 attaches to an inner sidewall of the flange 322 to cover the opening 32 or slides backwards from the flange 322 to open the opening 32. The valve 38 is a rectangular plane, which is greater in size than the opening 32. The valve 38 is made of magnetic material, and has an outer surface with a magnetic polarity, such as south polarity, facing the opening 32. When the external sound box is not applied to the electronic device 500, the valve 38 is magnetically attracted with the magnetic attracter 34 and attached to an inner sidewall of the flange 322, thereby covering the opening 32 to form a closed internal sound chamber 30.

The guiding portion 39 at least includes a resisting wall 392 extending from the inner wall of the internal sound chamber 30 and opposite to the opening 32. The guiding portion 39 further includes a guiding wall 394 surrounding the opening 32 and extending between the opening 32 and the resisting wall 392. The guiding wall 394 provides a path for valve 38 to slide between the opening 32 and the resisting wall 392 to prevent movement shift of the valve 38. The space surrounded by the guiding portion 39 communicates with other space of the internal sound chamber 30.

Figure 3:
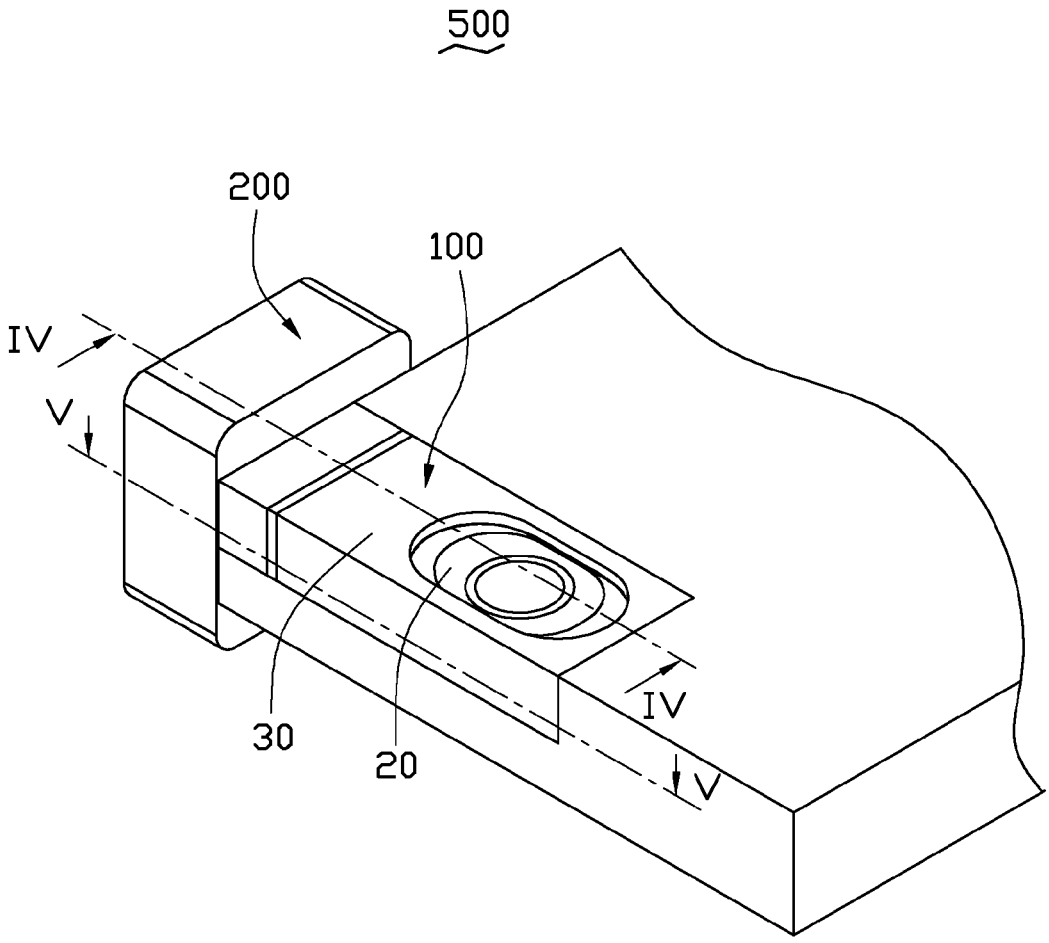
FIG. 3 is an isometric view of the electronic device connected to the external sound box shown in FIG. 1.
Figure 4:
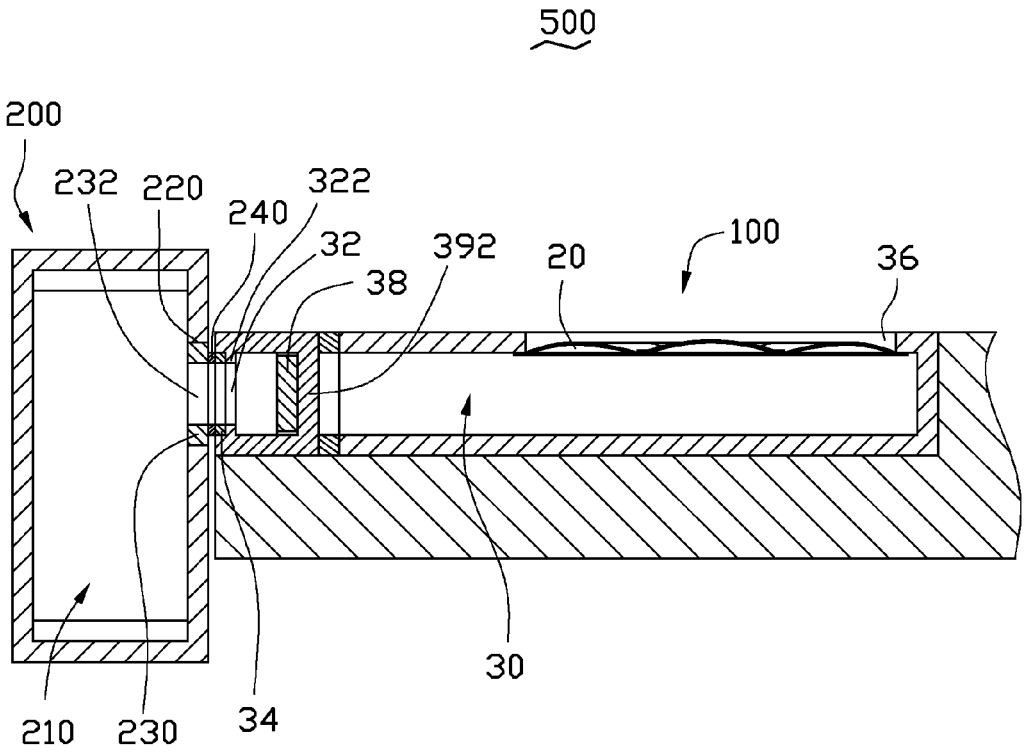
FIG. 4 is a cross-section view taken along line IV-IV of FIG. 3.

FIGS. 3 and 4 show the external sound box 200 connected to the internal speaker module 100 of the electronic device 500. The external sound box 200 is hollow and defines an external sound chamber 210. The volume of the external sound chamber 210 is greater than the internal sound chamber 30. An inner surface of the external sound chamber 210 is made of airtight material, to prevent sound leakage from the external sound chamber 210.

The external sound box 200 includes a window 220, a connector 230, and a seal portion 240. The window 220 is defined on a sidewall of the external sound chamber 210. In the exemplary embodiment, the window 220 is defined in an appearance surface of the external sound box 200.

The connector 230 is mounted in the window 220. The connector 230 is annular and defines a connecting hole 232 in a central portion. The connecting hole 232 is for communicating between the inner space of the external sound chamber 210 and the outside of the external sound box 200. The size of the connecting hole 232 is substantially the same as the size of the opening 32. The connector 230 is made of magnetic material and has an outer surface with a magnetic polarity the same as the outer surface of the valve 38. In use, the connector 230 is magnetically attracted to the magnetic attracter 34 and thus attached to the electronic device 500. Simultaneously, the valve 38 is magnetically repelled by the connector 230 and slides away from the opening 32 until resisting with the resisting wall 394, thus the external sound box 200 is communicating with the internal speaker module 100 via the opening 32.

The seal portion 240 is mounted on the outer surface of the connector 230. The seal portion 240 is annular shaped and defines a hole aligned with the connecting hole 232. The seal portion 240 is made of airtight material.

Figure 5:
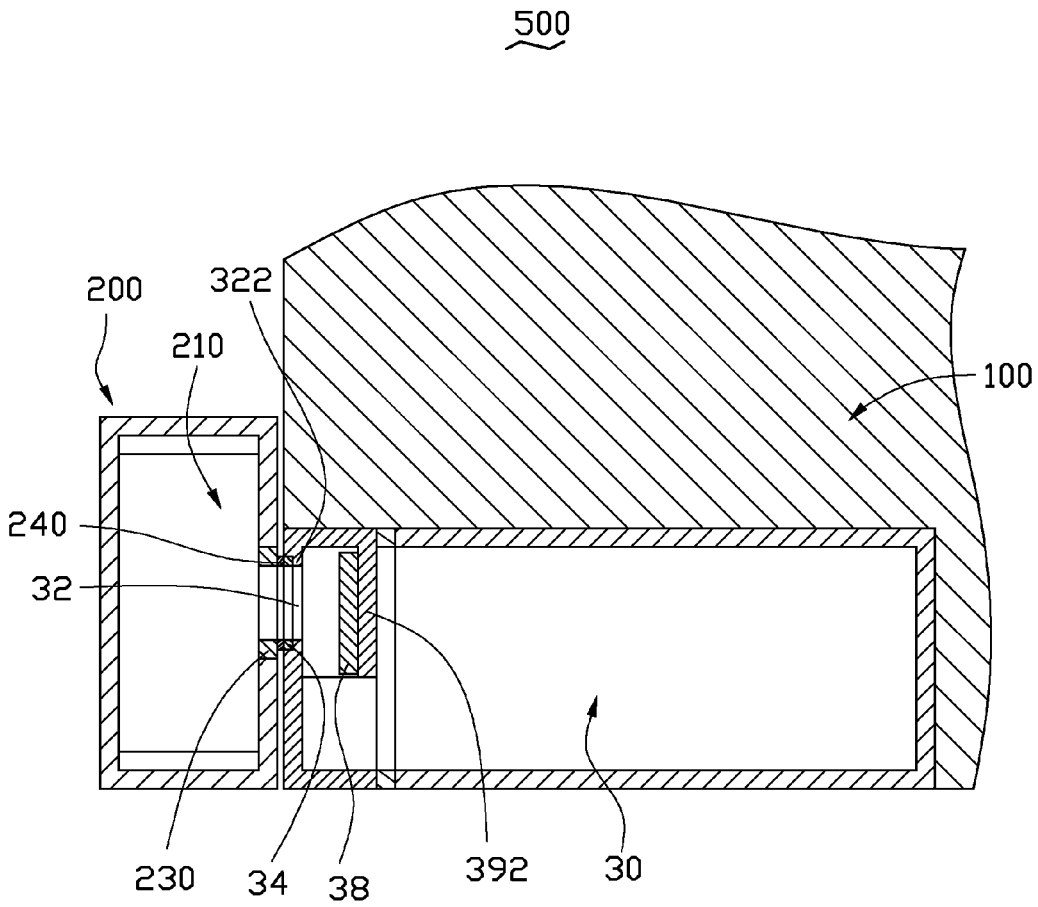
FIG. 5 is a cross-section view taken along line V-V of FIG. 3.
Figure 6:
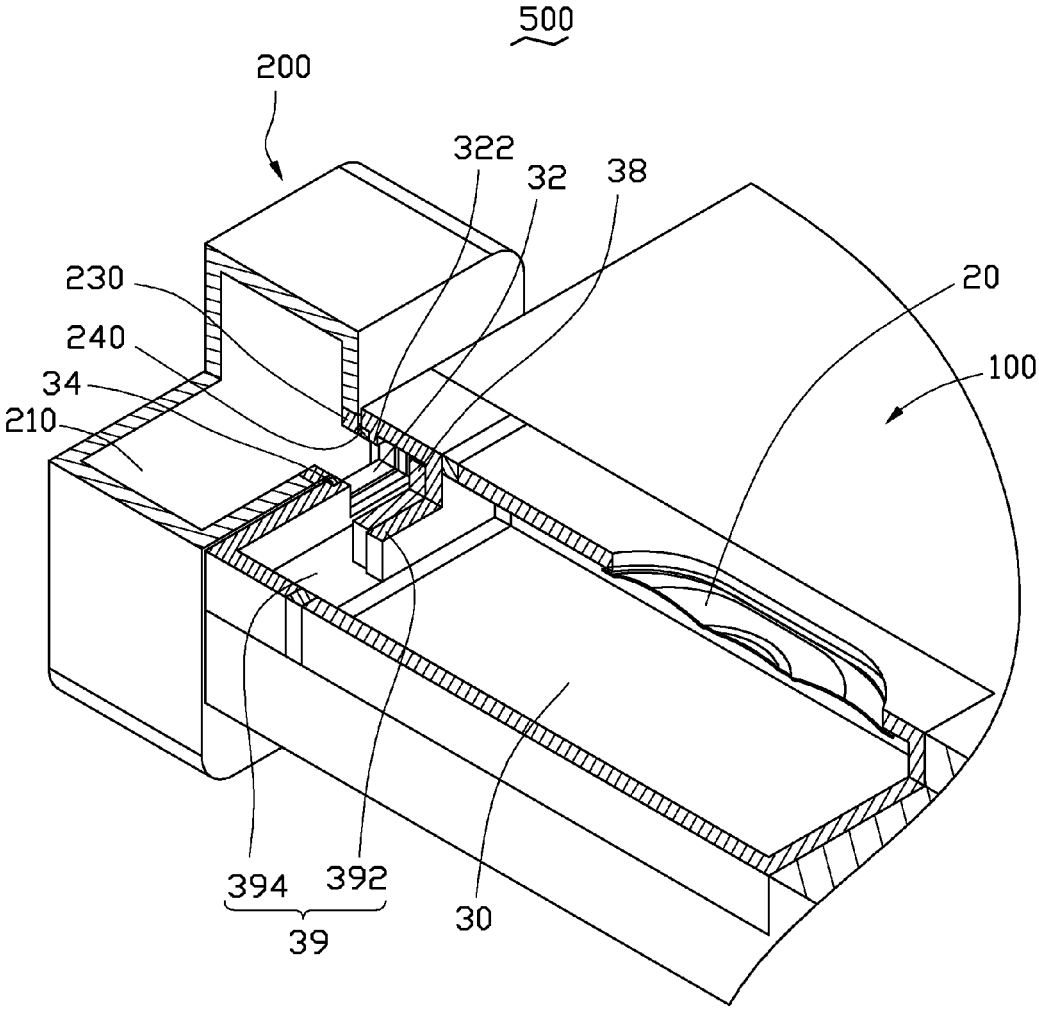
FIG. 6 is an isometric cut-away view of the electronic device connected to the external sound box shown in FIG. 3.

FIGS. 5 and 6 show that when the external sound box 200 moves towards the internal speaker module 100, the connector 230 is magnetically attracted with the magnetic attracter 34. Simultaneously, the surface of the connector 230 facing the magnetic attracter 34 has the same magnetic polarity, such as south polarity, with the surface of the valve 38 facing the magnetic attracter 34. Thus the connector 230 magnetically repels the valve 38, thereby the valve 38 is pushed by the magnetic repulsion from the connector 230 and slides away from the flange 322 opening the opening 32. Until the connector 230 resists to the magnetic attracter 34, the valve 38 resists to the resisting wall 392. Therefore, the connecting hole 232 is aligned with the opening 32, which allows the external sound chamber 210 of the external sound box 200 to communicate with the internal sound chamber 30 to form a greater sound chamber. Sound generated by the speaker 20 resonates the internal sound chamber 30 and the external sound chamber 210, which enforces the sound performance, since a larger resonating space is provided. The seal portion 240 is resisted between the connector 230 and the magnetic attracter 34, which prevents any sound leakage from the connection of the internal sound chamber 30 and the external sound chamber 210.

The electronic device 500 employs the external sound box 200, which is connected to, and communicating with the internal speaker module 100, thus providing a larger resonating space for sound generated by the speaker 20. In addition, the external sound box 200 automatically connects to the internal speaker module 100 by magnetic connection between the magnetic connector 230 and the magnetic attracter 34, meanwhile generating magnetic repulsion to force the valve 38 to move away from the opening 32. Therefore, the external sound box 200 is convenient for applying to the internal speaker module 100.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A speaker module for an electronic device, comprising:
an internal speaker module, comprising:
a speaker; and
an internal sound chamber, the internal sound chamber receiving the speaker therein and providing a resonating space for sound generated by the speaker, the internal sound chamber including:
an opening defined on one end portion of the internal sound chamber, and communicating with the resonating space;
a magnetic attracter mounted to the end portion;
a valve mounted in the internal sound chamber and made of magnetic material; and
an external sound box detachably applied to the internal speaker module, comprising:
an additional resonating space therein;
a window defined on a sidewall of the external sound box, and communicating with the additional resonating space; and
a connector mounted to the sidewall and made of magnetic material;
wherein when the external sound box is separated from the internal speaker module, the valve is magnetically attracted with the magnetic attracter and covers the opening to form a closed resonating space for the internal sound chamber; and when the external sound box is coupled to the internal speaker module, the connector is magnetically attracted with the magnetic attractor to connect the external sound box to the internal speaker module, and the valve is magnetically repelled with the magnetic attracter and moves away from the opening to allow communication between the additional resonating space and the resonating space via the window and the opening.

2. The speaker module as claimed in claim 1, wherein an inner surface of the internal sound chamber is made of airtight material.

3. The internal speaker module as claimed in claim 1, wherein the internal speaker module further includes a receiving hole away from the opening, the receiving hole communicates between an inside of the resonating space and an outside of the speaker module.

4. The internal speaker module as claimed in claim 3, wherein the speaker is received in the receiving hole.

5. The internal speaker module as claimed in claim 1, wherein the magnetic attracter defines a hole in a central portion thereof to expose the opening.

6. The speaker module as claimed in claim 1, wherein the internal sound chamber further includes a flange surrounding an inner wall of the opening, when the valve is magnetically attracted with the magnetic attracter and resists to the flange, the valve covers the opening.

7. The speaker module as claimed in claim 6, wherein the internal sound chamber further includes a guiding portion mounted opposite to the opening in the internal sound chamber, when the valve is magnetically repelled from the magnetic attracter and the valve moves away from the opening along the guiding portion, until the valve is resisted by the guiding portion.

8. The speaker module as claimed in claim 7, wherein the guiding portion includes a resisting wall extended from an inner wall of the internal sound chamber and opposite to the opening.

9. The speaker module as claimed in claim 8, wherein the guiding portion further includes a guiding wall surrounding the opening and extends between the opening and the resisting wall, the valve slides along the guiding wall until resisted by the resisting wall.

10. The speaker module as claimed in claim 1, wherein the external sound box is hollow and forms an external sound chamber therein.

11. The speaker module as claimed in claim 1, wherein the connector has an outer surface with a magnetic polarity same with an outer surface of the valve.

12. The speaker module as claimed in claim 1, wherein the external sound box further includes a seal portion mounted on the outer surface of the connector, the seal portion defines a hole in a central portion corresponding to the connecting hole, the seal portion is made of airtight material.

13. The speaker module as claimed in claim 12, wherein the seal portion is resisted between the connector and the magnetic attracter when the external sound box is coupled to the internal speaker module.

14. An electronic device, comprising an internal speaker module and an external sound box detachably applied to the internal speaker module, the internal speaker module comprising:

a speaker; and an internal sound chamber receiving the speaker therein and providing a resonating space for sound generated by the speaker, the internal sound chamber including:

an opening defined on one end portion of the internal sound chamber, and communicating with the resonating space;

a magnetic attracter mounted to the end portion;

a valve mounted in the internal sound chamber and made of magnetic material; and the external sound box comprising:

an additional resonating space therein;

a window defined on a sidewall of the external sound box, and communicating with the additional resonating space; and a connector mounted to the sidewall and made of magnetic material;

wherein when the external sound box is separated from the internal speaker module, the valve is magnetically attracted with the magnetic attracter and covers the opening to form a closed resonating space for the internal sound chamber; and when the external sound box is coupled to the internal speaker module, the connector is magnetically attracted with the magnetic attractor to connect the external sound box to the internal speaker module, and the valve is magnetically repelled with the magnetic attracter and moves away from the opening to allow communication between the additional resonating space and the resonating space via the window and the opening.

15. The electronic device as claimed in claim 14, wherein the internal sound chamber further includes a flange surrounding an inner wall of the opening, when the valve is magnetically attracted with the magnetic attracter and resists to the flange, the valve covers the opening.

16. The electronic device as claimed in claim 15, wherein the internal sound chamber further includes a guiding portion mounted opposite to the opening in the internal sound chamber, when the valve is magnetically repelled from the magnetic attracter and moves away from the opening along the guiding portion, until the valve is resisted by the guiding portion.

17. The electronic device as claimed in claim 16, wherein the guiding portion includes a resisting wall extended from an inner wall of the internal sound chamber and opposite to the opening.

18. The electronic device as claimed in claim 17, wherein guiding portion further includes a guiding wall surrounding the opening and extends between the opening and the resisting wall, the valve slides along the guiding wall until resisted by the resisting wall.

19. The electronic device as claimed in claim 14, wherein the connector has an outer surface with a magnetic polarity same with an outer surface of the valve.

20. The electronic device as claimed in claim 19, wherein the external sound box further includes a seal portion mounted on the outer surface of the connector, the seal portion defines a hole in a central portion corresponding to the connecting hole, the seal portion is made of airtight material, the seal portion is resisted between the connector and the magnetic attracter when the external sound box is coupled to the internal speaker module.

* * * * *